US011434590B2

(12) United States Patent
Harris

(10) Patent No.: US 11,434,590 B2
(45) Date of Patent: Sep. 6, 2022

(54) BRAIDED TEXTILE SLEEVE WITH LOCKED YARNS AND METHOD OF CONSTRUCTION THEREOF

(71) Applicant: FEDERAL-MOGUL POWERTRAIN LLC, Southfield, MI (US)

(72) Inventor: David A. Harris, Glenmoore, PA (US)

(73) Assignee: Federal-Mogul Powertrain LLC, Southfield, MI (US)

( * ) Notice: Subject to any disclaimer, the term of this patent is extended or adjusted under 35 U.S.C. 154(b) by 258 days.

(21) Appl. No.: 16/046,919

(22) Filed: Jul. 26, 2018

(65) Prior Publication Data

US 2019/0032255 A1 Jan. 31, 2019

Related U.S. Application Data

(60) Provisional application No. 62/538,534, filed on Jul. 28, 2017.

(51) Int. Cl.
*D04C 1/06* (2006.01)
*D04C 1/02* (2006.01)

(52) U.S. Cl.
CPC ..... *D04C 1/06* (2013.01); *D04C 1/02* (2013.01); *D07B 2201/209* (2013.01); *D10B 2401/041* (2013.01)

(58) Field of Classification Search
CPC ..... D04C 1/02; D04C 1/06; D10B 2401/041
See application file for complete search history.

(56) References Cited

U.S. PATENT DOCUMENTS 4,271,329 A * 6/1981 Perelmuter ..... D04C 1/02 174/84 R
4,741,087 A * 5/1988 Plummer, Jr. ..... B29C 61/0658 138/123
4,777,859 A * 10/1988 Plummer, Jr. ..... B29C 61/0658 87/7
2007/0141335 A1* 6/2007 Perera ..... D03D 15/00 428/375
2009/0311456 A1* 12/2009 Harris ..... B32B 5/022 428/36.1
2014/0220276 A1 8/2014 Gao et al.
2014/0272218 A1 9/2014 Thomas et al.
2016/0021799 A1* 1/2016 Harris ..... D03D 1/0088 174/350

(Continued)

FOREIGN PATENT DOCUMENTS

CN 105144516 A 12/2015
CN 106660304 A 5/2017
WO 2016010730 A1 1/2016

OTHER PUBLICATIONS

International Search Report, dated Nov. 13, 2018 (PCT/US2018/044079).

*Primary Examiner* — Shaun R Hurley
(74) *Attorney, Agent, or Firm* — Robert L. Stearns; Dickinson Wright, PLLC

(57) ABSTRACT

A protective braided sleeve and method of construction are provided. The braided sleeve includes a seamless, circumferentially continuous, tubular wall extending lengthwise along a central longitudinal axis between opposite ends. The wall includes a plurality of yarns braided with one another. At least one of the yarns is activatable to lock the plurality of yarns in fixed relation with one another to inhibit the expansion of the wall.

17 Claims, 5 Drawing Sheets

(56) References Cited

U.S. PATENT DOCUMENTS

| | | | | |
|---|---|---|---|---|
| 2016/0122915 | A1 | 5/2016 | Fathallah et al. | |
| 2016/0144805 | A1* | 5/2016 | Yamaguchi | B29C 65/002 181/207 |
| 2017/0056065 | A1* | 3/2017 | Do | A61B 17/0293 |
| 2017/0167062 | A1 | 6/2017 | Malloy et al. | |
| 2017/0207005 | A1* | 7/2017 | Khosroshahi | H01B 17/58 |

* cited by examiner

BRAIDED TEXTILE SLEEVE WITH LOCKED YARNS AND METHOD OF CONSTRUCTION THEREOF

CROSS-REFERENCE TO RELATED APPLICATION

This application claims the benefit of U.S. Provisional Application Ser. No. 62/538,534, filed Jul. 28, 2017, which is incorporated herein by reference in its entirety.

BACKGROUND OF THE INVENTION

1. Technical Field

This invention relates generally to textile sleeves, and more particularly to braided textile sleeves.

2. Related Art

It is known to protect elongate members in braided textile sleeves against a variety of environmental conditions and affects and for bundling and routing purposes. Braided sleeves commonly have a wall braided as a circumferentially continuous, seamless wall, sometimes referred to as a 'closed' wall. One known advantage of a closed, braided wall construction is that the wall can be circumferentially expanded to facilitate sliding the wall over an elongated member by manually pushing and physically holding the opposite ends of the wall in a compressed fashion. By pushing the opposite ends toward one another and manually holding the wall in an axially compressed state, the braided wall is caused to take on an increased diameter and a reduced length. When in the increased diameter state, the wall can be readily disposed over the elongate member. Then, after sleeve is installed over the elongate member, the installer can release and stretch the wall, thereby taking on a circumferentially decreased diameter and increased length. Then, in order to maintain the sleeve in an "as intended" installed state, tape is commonly wrapped about at least a portion of the sleeve to prevent the yarns from shifting and expanding, thereby fixing the sleeve in the desired location. The tape is also typically adhered to an outer surface of the elongate member being protected by the sleeve to further fix the sleeve in its desired location.

The aforementioned ability to fix the yarns of the braided wall in their intended location and to fix the sleeve in an intended location on the elongate member via tape comes with potential drawbacks. For example, the tape must be purchased separately and inventoried, thereby adding cost to the application. Further, the tape can become damaged and/or contaminated during assembly and while in use, thereby affecting its ability to maintain the yarns and the sleeve in their intended fixed location. Further yet, the tape can be unsightly upon application, or can otherwise become unsightly over time. Additionally, application of tape can be labor intensive, thereby adding further cost to the application.

SUMMARY OF THE INVENTION

In accordance with one aspect of the invention, a protective textile sleeve includes a seamless, circumferentially continuous, tubular braided wall extending lengthwise along a central longitudinal axis between opposite ends. The wall includes a plurality of yarns braided with one another, with at least one or more of the yarns being an activatable adhesive yarn to bond the yarns in fixed relation with one another, upon selective activation of the at least one activatable yarn, to inhibit the expansion of the braided wall upon being activated, thereby maintaining the wall in the desired confirmation upon assembly without the need for secondary fixation mechanisms.

In accordance with another aspect of the invention, the braided yarns, in addition to the activatable yarns, can include heat-shrinkable and non-heat-shrinkable yarns, with the heat-shrinkable yarns being oriented relative to the non-heat-shrinkable yarns to facilitate locking the yarns relative to one another upon the heat-shrinkable yarns being shrunken.

In accordance with another aspect of the invention, the activatable yarns can be at least one of UV activatable, heat-activatable or chemically activatable.

In accordance with another aspect of the invention, the activatable yarns can be bicomponent filaments including a core and an activatable outer sheath, wherein the outer sheath can be a hot melt material, wherein the hot melt material has a lower melt temperature than the core, such that when the outer sheath is melt, the core remains unmelted to provide stability and structure to the sleeve.

In accordance with another aspect of the invention, the bicomponent can be provided wherein the inner core is heat-settable, and wherein the outer sheath and the inner core are activatable to melt and heat-set, respectively, at the same temperature.

In accordance with another aspect of the invention, the at least one activatable yarn can include a low melt yarn (being constructed at least in part via a hot melt material) provided to melt and solidify and bond abutting ones of said yarns with one another.

In accordance with another aspect of the invention, the wall can include non-activatable yarn, with the hot melt material of the at least one activatable yarn having a lower melt temperature than the non-activatable yarn.

In accordance with another aspect of the invention, the at least one activatable yarn and the non-activatable yarn can be provided in an equal number of ends with one another.

In accordance with another aspect of the invention, the activatable yarns and the non-activatable yarns can be braided in a respective 1:1 braid pattern, with the activatable yarns and the non-activatable yarns alternating with one another in opposite S and Z helical directions.

In accordance with another aspect of the invention, the activatable yarns and the non-activatable yarns can be braided in a respective 1:2 braid pattern, with the activatable yarns and the non-activatable yarns alternating with one another in opposite S and Z helical directions, thus reducing the more costly content of the activatable yarn relative to the non-activatable yarn and enhancing flexibility of the sleeve by reducing the amount of melted and solidified material, relative to a sleeve having a greater content of activatable yarn.

In accordance with another aspect of the invention, the activatable yarns and the non-activatable yarns can be braided in a respective 1:3 braid pattern, with the activatable yarns and the non-activatable yarns alternating with one another in opposite S and Z helical directions.

In accordance with another aspect of the invention, the activatable yarns and the non-activatable yarns can be braided in a respective 2:1 braid pattern, with the activatable yarns and the non-activatable yarns alternating with one another in opposite S and Z helical directions, thereby providing an enhanced bond force between the yarns by providing a greater number of activatable yarns relative to non-activatable yarns.

In accordance with another aspect of the invention, the activatable yarns and the non-activatable yarns can be braided in a respective 3:1 braid pattern, with the activatable yarns and the non-activatable yarns alternating with one another in opposite S and Z helical directions.

In accordance with another aspect of the invention, the entirety of the yarns can include a low melt material provided to melt and solidify and bond abutting ones of the yarns with one another.

In accordance with another aspect of the invention, at least one of the yarns of the sleeve can be provided as being a non-activatable monofilament and/or multifilament, as desired to provide the sleeve with the desire type of protection and flexibility.

In accordance with another aspect of the invention, the at least one activatable yarn can be heat-shrinkable.

In accordance with another aspect of the invention, a method of constructing a braided textile sleeve includes braiding a plurality of yarns with one another to form a seamless tubular wall extending lengthwise along a central longitudinal axis, with at least some of the yarns being provided as activatable yarns, which, upon being activated, bond with and lock the yarns of the sleeve relative to one another, thereby maintaining the wall in the desired configuration upon assembly without the need for secondary fixation mechanisms.

In accordance with another aspect of the invention, the method can include providing at least one or more of the braided activatable yarns as heat-fusible yarn (referred to herein as a low melt yarn), such as formed at least in part including an exposed hot melt material.

In accordance with another aspect of the invention, the method can further include providing the yarns as heat-shrinkable and non-heat-shrinkable yarns, with the heat-shrinkable yarns being oriented relative to the non-heat-shrinkable yarns to facilitate locking the yarns relative to one another upon the heat-shrinkable yarns being shrunken.

In accordance with another aspect of the invention, the method can further include braiding the heat-shrinkable yarns and the non-heat-shrinkable yarns in alternating relation with one another in both S and opposite Z helical directions about the circumference of the sleeve to provide the sleeve with a substantially balanced content of the heat-shrinkable yarns and the non-heat-shrinkable yarns.

In accordance with another aspect of the invention, the method can further include providing the activatable yarns as at least one of UV activatable yarns, heat-activatable yarns, or chemically activatable yarns.

In accordance with another aspect of the invention, the method can further include providing the activatable yarns as bicomponent filaments including a core and an activatable outer sheath, wherein the outer sheath can be a hot melt material having a lower melt temperature than the core.

In accordance with another aspect of the invention, the method can further include providing the core being heat-settable at the same temperature used to melt the outer sheath.

In accordance with another aspect of the invention, the method can further include braiding the at least one activatable yarn and the non-activatable yarn in an equal number of ends with one another.

In accordance with another aspect of the invention, the method can further include braiding the activatable yarns and the non-activatable yarns in a respective 1:1 braid pattern, with the activatable yarns and the non-activatable yarns alternating with one another in opposite S and Z helical directions.

In accordance with another aspect of the invention, to enhance flexibility and reduce cost of the activatable yarn over a 1:1 ratio, the method can further include braiding the activatable yarns and the non-activatable yarns in a respective 1:2 braid pattern, with the activatable yarns and the non-activatable yarns alternating with one another in opposite S and Z helical directions.

In accordance with another aspect of the invention, to enhance flexibility and reduce cost of the activatable yarn over a 1:2 ratio, the method can further include braiding the activatable yarns and the non-activatable yarns in a respective 1:3 braid pattern, with the activatable yarns and the non-activatable yarns alternating with one another in opposite S and Z helical directions.

In accordance with another aspect of the invention, to enhance rigidity and bond strength between the yarns over a 1:1 ratio, the method can further include braiding the activatable yarns and the non-activatable yarns in a respective 2:1 braid pattern, with the activatable yarns and the non-activatable yarns alternating with one another in opposite S and Z helical directions.

In accordance with another aspect of the invention, to enhance rigidity and bond strength between the yarns over a 2:1 ratio, the method can further include braiding the activatable yarns and the non-activatable yarns in a respective 3:1 braid pattern, with the activatable yarns and the non-activatable yarns alternating with one another in opposite S and Z helical directions.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
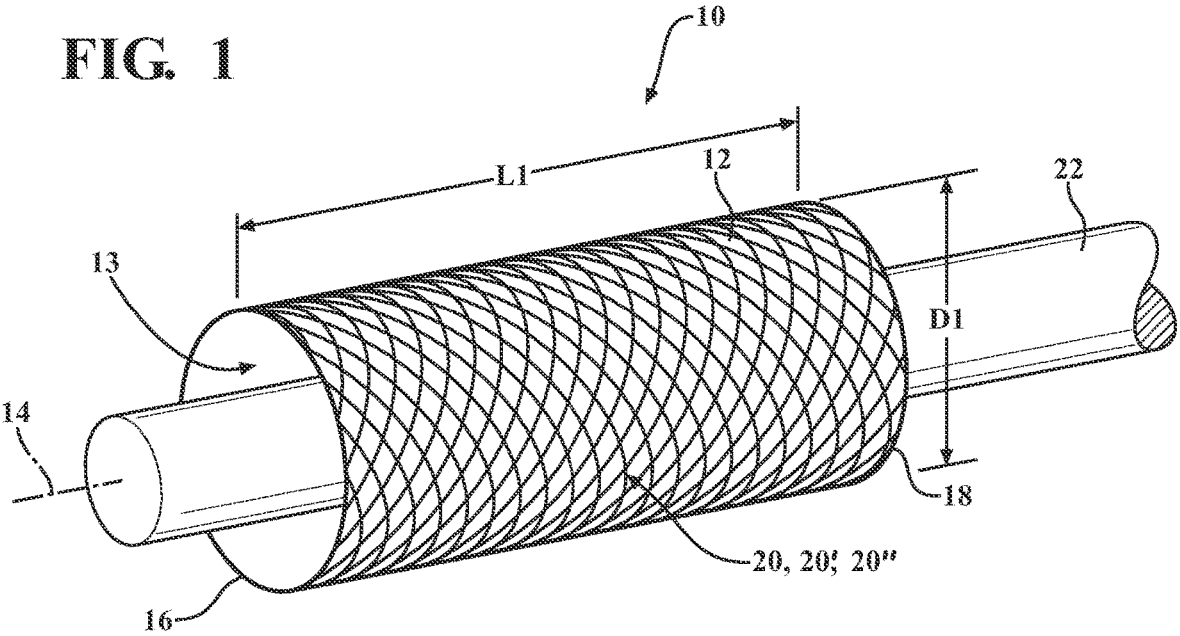
FIG. 1 is a schematic perspective view of a tubular braided sleeve constructed in accordance with one embodiment of the invention shown in an axially compressed, pre-activated first state.
Figure 2:
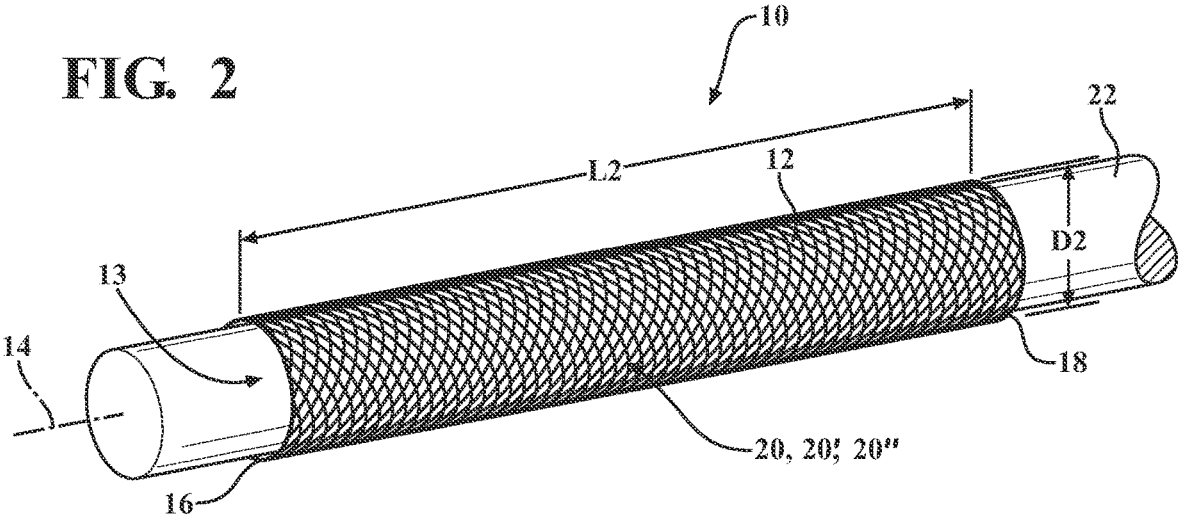
FIG. 2 is a view similar to FIG. 1 with the tubular braided sleeve shown in an axially extended, activated second state.

Referring in more detail to the drawings, FIGS. 1 and 2 illustrate a tubular braided protective textile sleeve, referred to hereafter as sleeve 10, constructed in accordance with one aspect of the invention. The sleeve 10, as braided in a single, continuing braiding process, has a braided, circumferentially continuous, seamless tubular wall 12 bounding a through passage, also referred to as cavity 13, extending lengthwise along a central longitudinal axis 14 between open opposite ends 16, 18. The wall 12 is axially compressible to attain an assembly, nonactivated first state, wherein a plurality (intended to mean more than 1 yarn and equal to or less than the entirety of the yarns) braided yarns, indicated generally at 20, forming the wall 12 are free to shift, also referred to as slide, relative to one another, such that the nonactivated first state provides the wall 12 having an ability to be axially compressed to a decreased length L1 and increased diameter D1 (FIG. 1) via expanded relative movement of the braided yarns 20 and is axially extendible to attain an increased length L2 and decreased diameter D2 (FIG. 2) via contracted relative movement of the braided yarns 20. While the wall 12 is at least partially or fully biased into the axially compressed, assembly friendly first state, the wall 12 is able to be readily assembled about an elongate member 22 to be protected, with the wall 12, and thus, the cavity 13, having an enlarged diameter relative to the elongate member 22, and then, while in the axially extended second state, at least one or more ends (end, as understood in the art is a single yarn filament) of the braided yarns 20 forming the wall 12 is/are provided as activatable yarn 20', which upon being activated, selectively lock the yarns 20 relative to one another, thereby maintaining and preventing the yarns 20 from shifting relative to one another, and thus, maintaining the wall 12 in its desired assembled configuration (length and diameter) and location relative to the elongate member 22. Accordingly, the sleeve 10 is able to remain in its intended, as assembled location along the elongate member 22 without need for secondary fixation mechanisms, such as tape, tie wraps and the like, thereby enhancing assembly efficiencies, reducing cost, and improving the overall appearance of the assembly over the useful life thereof.

Figure 3A:
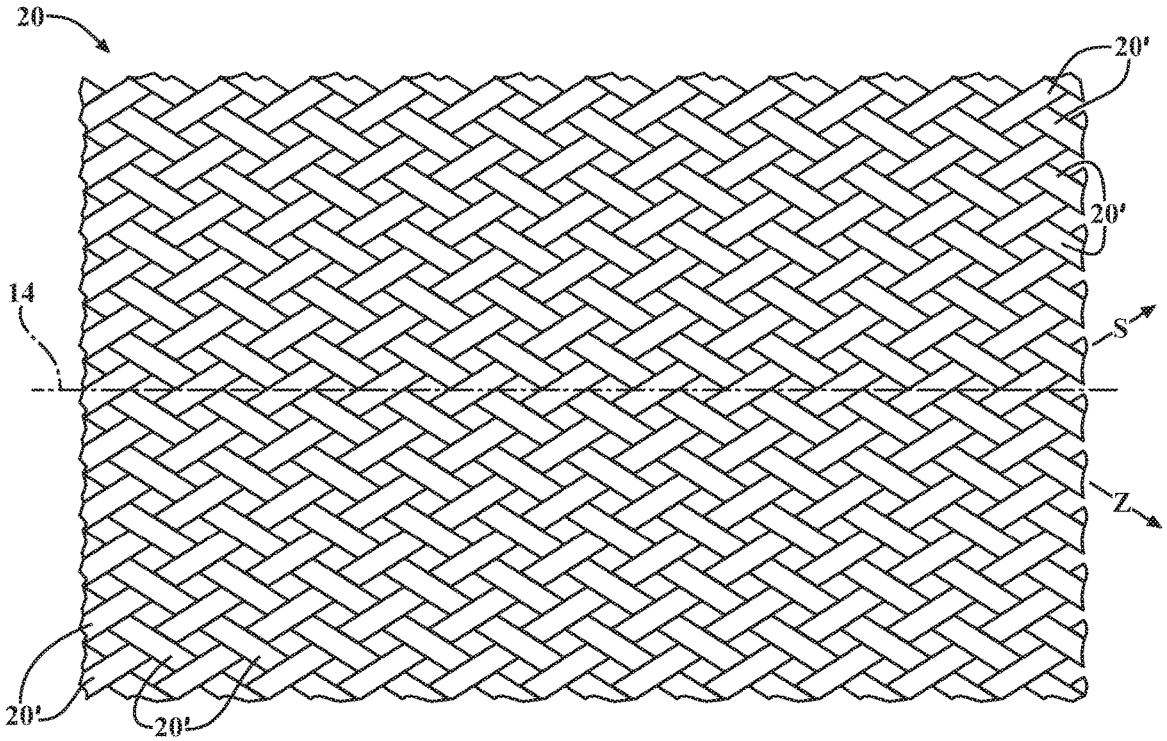
FIGS. 3A-3F illustrate plan views of a portion of wall of a tubular braided sleeve in accordance with different aspects of the disclosure.
Figure 3B:
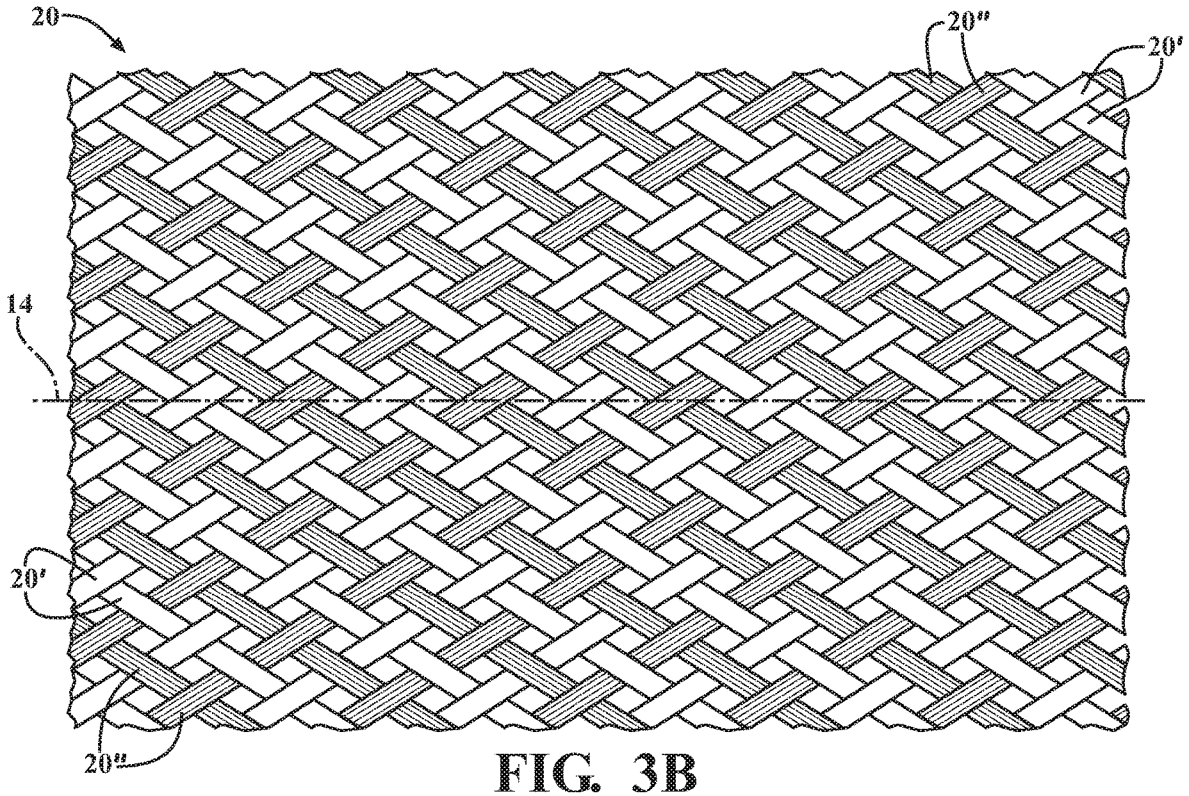
Figure 3C:
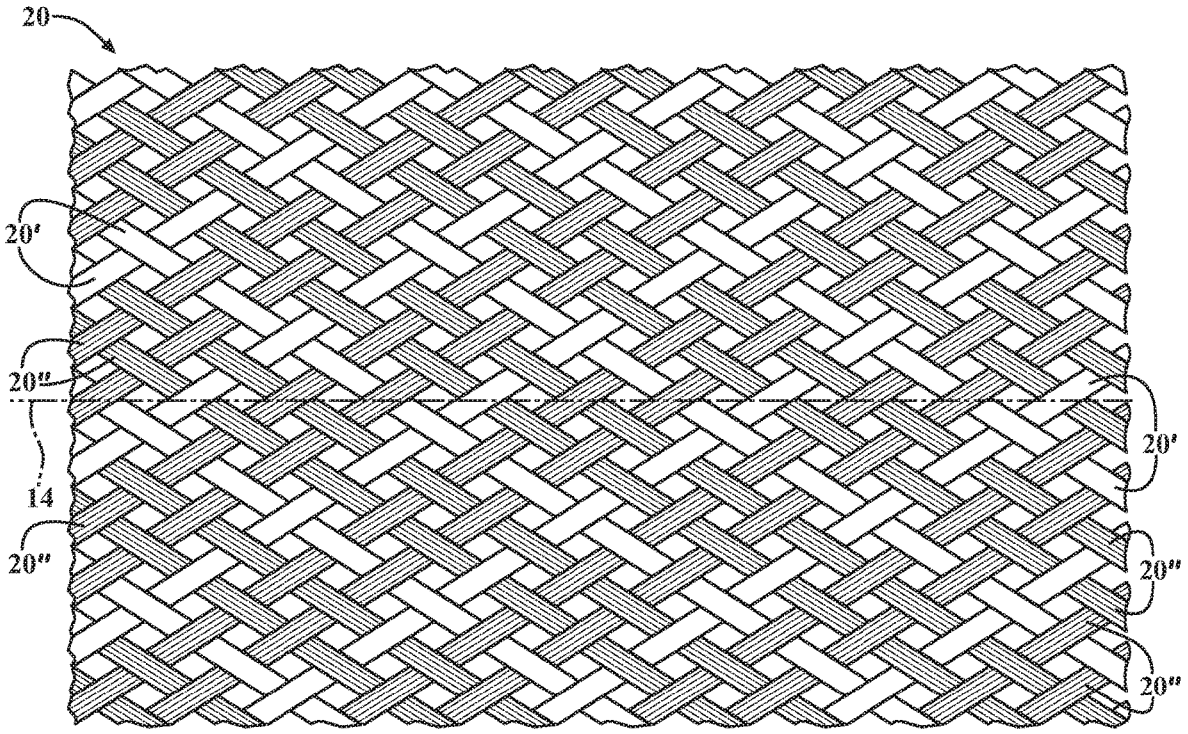
Figure 3D:
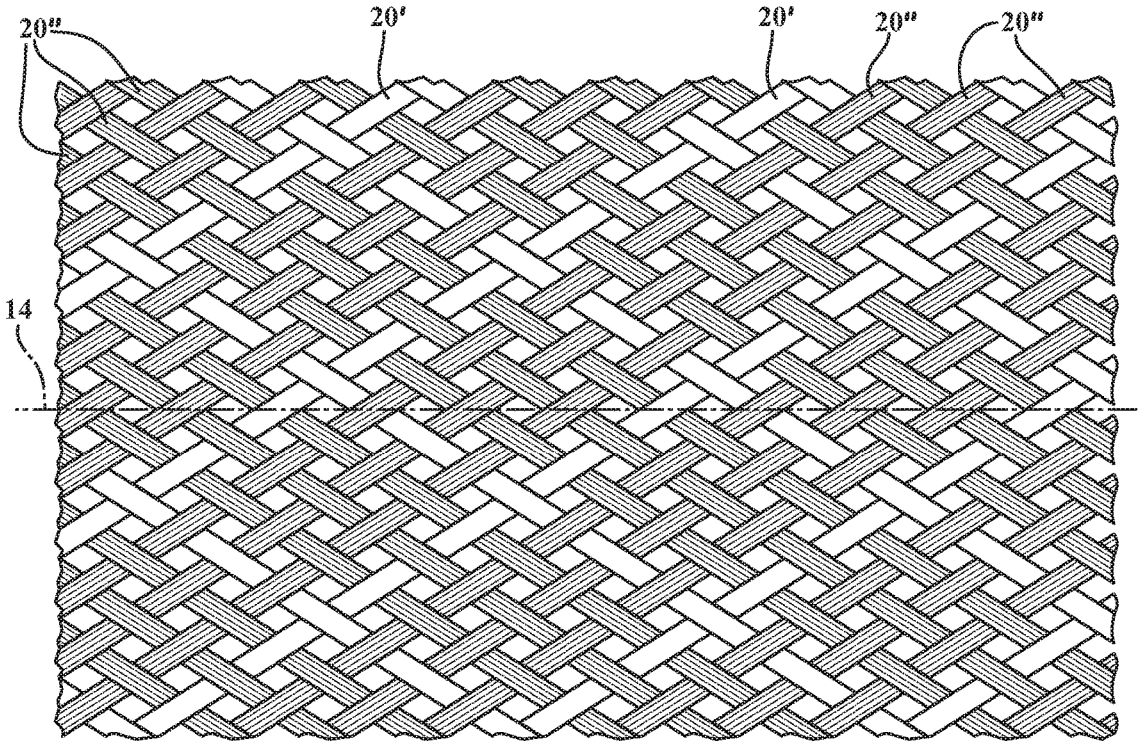
Figure 3E:
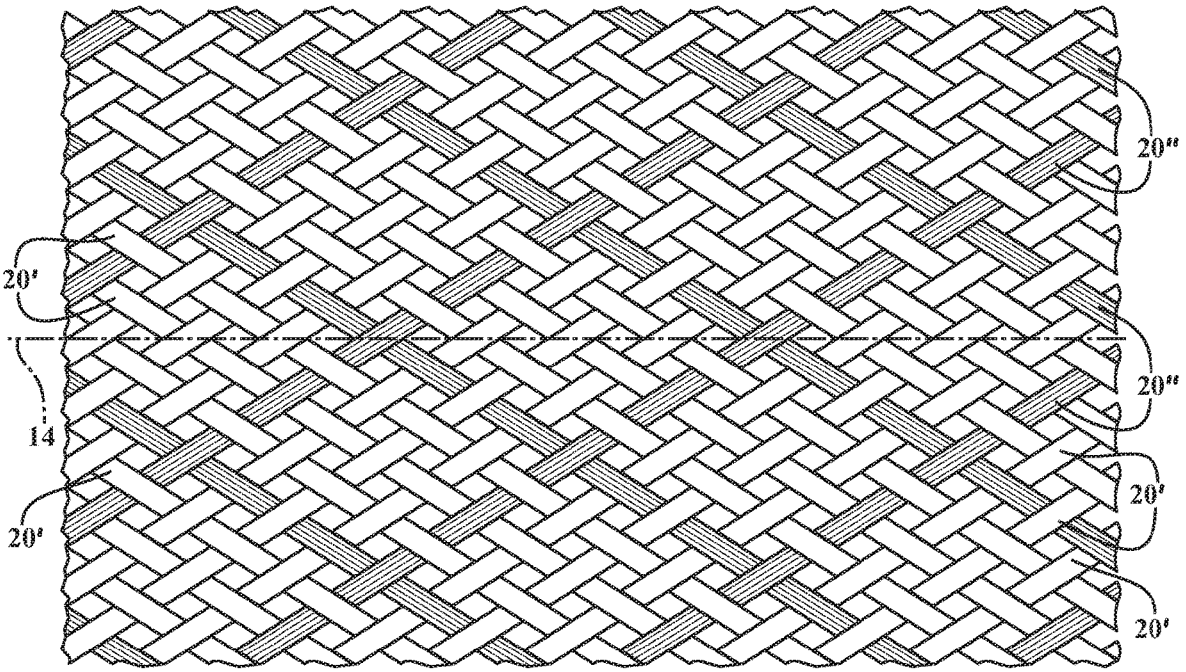
Figure 3F:
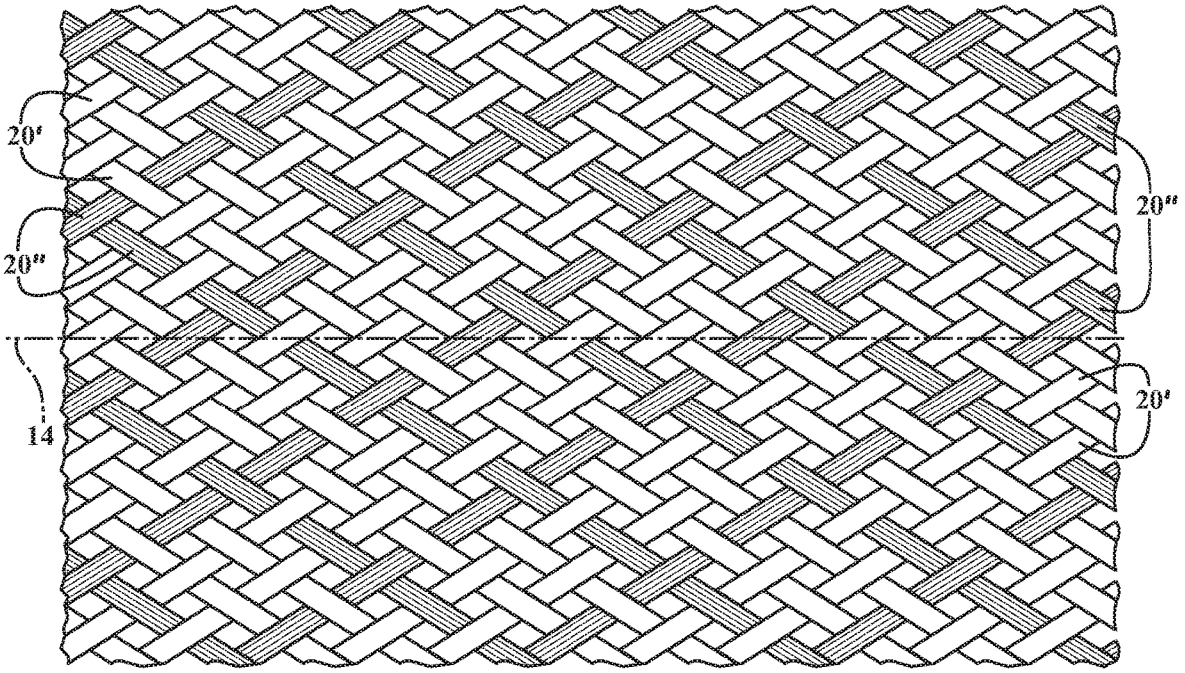

The braided yarns 20 forming the entirety of the wall 12 can be provided entirely as activatable yarn 20' (FIG. 3A). Otherwise, as few as one or more of the yarns 20, but less than the entirety, forming the wall 12 can be provided as activatable yarn 20', with the remainder of the yarns 20 being provided as non-activatable yarn 20". The activatable yarn 20' is provided as at least one of a heat-fusible yarn, such as from a hot melt material having a melt temperature less than the melt temperature of the non-activatable yarns 20", and/or from a cross-linked heat-shrinkable yarn (heat-shrinkable is intended to mean yarns that can be activated to shrink 10% or more, up to 90%, of their original, non-activated length). As noted, the yarns 20 forming a portion of the wall 12 can also include non-activatable yarn 20", and if incorporated, can be provided as any desired type of non-activatable yarn, whether monofilament and/or multi-filament, such that the non-activatable yarn 20" is neither readily heat-fusible (not readily capable of being heated to melt and solidify upon being cooled) nor heat-shrinkable (not capable of being shrunken up 10% of their original length). The activatable yarn 20' and non-activatable yarn 20", if non-activatable yarn 20" yarns are provided, can be provided a desired number of relative ends (an end is known as a single yarn) alternated with one another about the circumference of the sleeve 10 in the opposite S and Z helical directions (S and Z directions illustrated in FIG. 3A, as would be understood by a skilled artisan in the textile arts upon viewing the disclosure herein) in any desired respective ratio of ends of activatable yarn 20' to non-activatable yarn 20", such as 1:1 (FIG. 3B); 1:2 (FIG. 3C); 1:3 (FIG. 3D); 3:1 (FIG. 3E); or 2:1 (FIG. 3F), by way of example and without limitation, to provide the sleeve 10 with a substantially circumferentially balanced content of the activatable and non-activatable yarns 20', 20", as desired for the intended application and as needed for the desired strength of fixation of the activatable and non-activatable yarns 20', 20" with one another, with a higher content of activatable yarns 20' providing a greater bond of the yarns 20 with one another. The activatable yarns 20' can be at least one of UV activatable, heat activatable, fluid activatable, or otherwise.

Figure 4A:
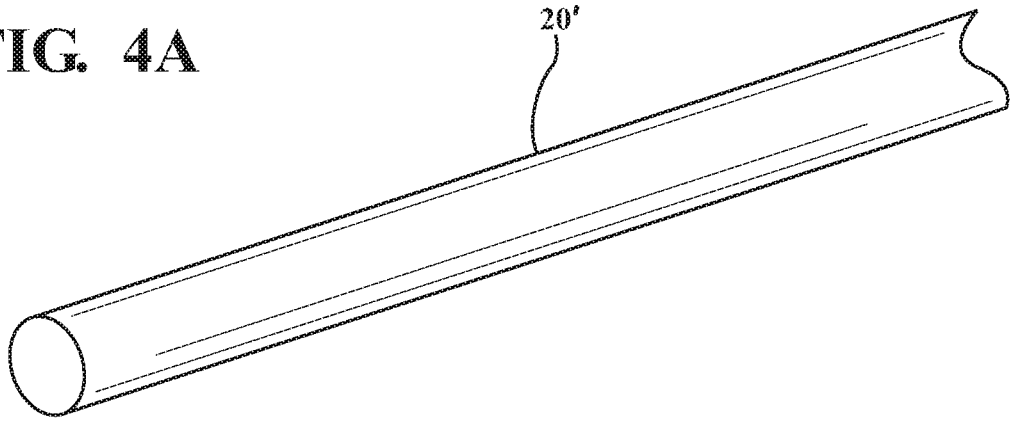
FIG. 4A is a fragmentary view of an activatable monofilament used in the construction of a tubular braided sleeve in accordance with an aspect of the disclosure.
Figure 4B:
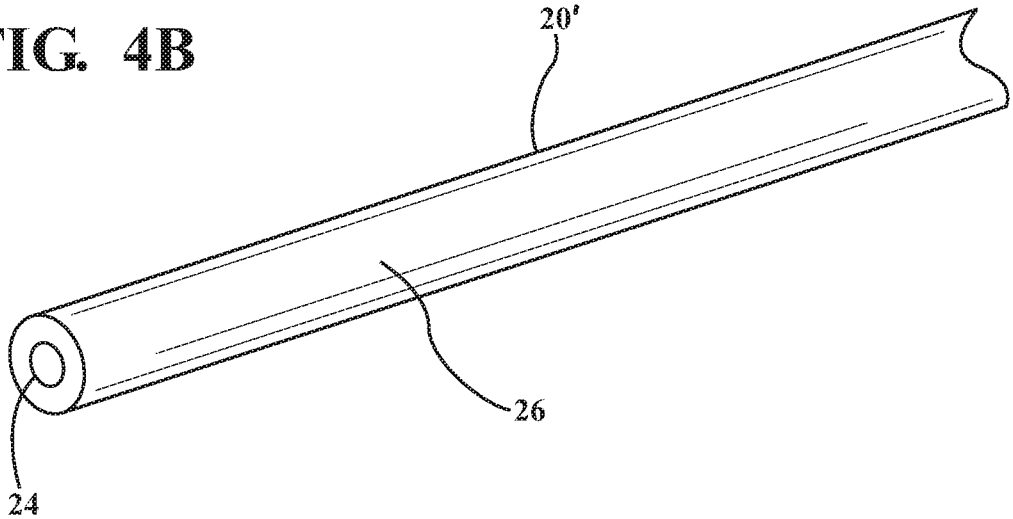
FIG. 4B is a fragmentary view of an activatable bicomponent filament used in the construction of a tubular braided sleeve in accordance with an aspect of the disclosure.

In accordance with another aspect of the invention, the activatable yarn(s) 20' can be provided as solid, monolithic pieces of a single material filament (FIG. 4A) and/or as bicomponent filament (FIG. 4B) including an inner core 24 (activatable, such as being heat-settable to take on a heat-set shape, or non-activatable) and an activatable outer sheath 26 surrounding the inner core 24, wherein the outer sheath 26 can be a hot melt material having a lower melt temperature than the material of the inner core 24, by way of example.

In use, the sleeve 10, with the activatable yarn 20' being braided and initially maintained in a non-activated first state, is disposed about the elongate member 22. While disposing the sleeve 10 about the elongate member 22, the yarns 20', 20" (if provided), are free to move and shift relative to one another, such that the wall 12 is able to be readily compressed axially and expanded radially to provide an enlarged through cavity 13 for the receipt of the elongate member 22 (FIG. 1). Then, upon locating the sleeve 10 in the desired location about the elongate member 22, the wall 12 can be axially stretched to take on an axially elongated, radially contracted state, such that the wall 12 is brought into snug or close fit relation about the elongate member 22 (FIG. 2). Then, the activatable yarn(s) 20' can be activated, such as via application of a suitable heat, UV, or chemical, for example, via any desired application process, wherein the activated yarn(s) 20' is either melted and/or shrunken to lock the entirety of the yarns 20 relative to one another. If melted, the yarns 20 are bonded with one another via melted and solidified material of the yarns 20', and if shrunken, the friction imparted between the yarns 20 and possibly with the elongate member 22 effectively locks the yarns 20 relative with one another. Accordingly, with the entirety of the yarns 20 being locked relative to one another, the wall 12 is assured of remaining in its intended location on the elongate member 22. Further yet, it bicomponent yarns 20' are provided, the inner core 24 is heat-set to retain is helical shape, thereby enhancing radial stiffness and providing the sleeve 10 with an enhanced crush and hoop strength, while the outer sheath 26 is melted and solidified to lock the yarns 20 to one another, as discussed above. It is to be recognized that the activation of the bicomponent yarns 20' can be performed at a single temperature suitable to heat-set the inner core 24 and melt the outer sheath 26.

In accordance with another aspect of the disclosure, a method of constructing a braided textile sleeve 10 is provided. The method includes braiding a plurality of yarns 20 with one another to form a seamless tubular wall 12 extending lengthwise along a central longitudinal axis 14, with at least some of the yarns 20 being provided as activatable yarns 20', which, upon being activated, via application of a source of heat, or chemical, or UV radiation, depending on the type of activatable yarn 20' used, lock the yarns 20 of the sleeve 10 relative to one another, thereby preventing the yarns 20 from slipping and expanding radially. Accordingly, the wall 12 is maintained in its intended configuration and location relative to an elongate member 22 extending therethrough.

The method can include providing at least one or more of the activatable braided yarns 20' as heat-fusible yarn, such as from a hot melt material. Further, the method can include providing one or more of the activatable yarns 20' as heat-shrinkable yarns, with the heat-fusible yarn 20' and/or heat-shrinkable yarns 20' being oriented relative to non-heat-fusible yarns 20" (if provided) and/or non-heat-shrinkable yarns 20" (if provided) to facilitate locking the yarns 20 relative to one another upon the non-heat-fusible yarns 20" being heated, melted and fused and/or heat-shrinkable yarns 20" being shrunken. If heat-shrinkable yarns 20' are provided in combination with heat-fusible yarns 20', the method can include providing the yarns 20' such that a common temperature can be used to both activate the shrinking and fusing, thereby simplifying the process, with the non-activatable yarns 20" being unaffected by the temperature used to shrink and melt the respective yarns 20'

In accordance with another aspect of the disclosure, the method can further include braiding activatable heat-fusible yarn 20' and/or heat-shrinkable yarns 20' and non-activatable, non-heat-shrinkable yarns 20" in alternating relation with one another about the circumference of the sleeve to provide the sleeve 10 with a substantially balanced content of the heat-fusible yarn 20' and/or heat-shrinkable yarns 20' and non-heat-shrinkable yarns 20".

In accordance with another aspect of the disclosure, the method can further include providing the activatable yarns 20' as at least one of UV activatable yarns, heat-activatable yarns, or otherwise.

In accordance with another aspect of the disclosure, the method can further include providing the activatable yarns 20' as bicomponent filaments including a non-activatable or activatable (heat-settable, takes on a heat-set shape without melting) core 24 and an activatable outer sheath 26, wherein the outer sheath 26 can be a hot melt, fusible material having a melt temperature lower than the melt temperature of the material of the core 24, wherein the inner core 24 and outer sheath 26 can be activated at the same temperature suitable to both heat-set the inner core 24 and melt the outer sheath 26.

Many modifications and variations of the present invention are possible in light of the above teachings. In addition, it is to be recognized that a braided tubular wall constructed in accordance with the various aspects of the invention can take on a multitude of uses, including that of a protective or bundling member, by way of example and without limitation. It is, therefore, to be understood that the invention may be practiced otherwise than as specifically described, and that the scope of the invention is defined by any ultimately allowed claims.

What is claimed is:

1. A protective braided sleeve, comprising:

a seamless, circumferentially continuous, tubular wall extending lengthwise along a central longitudinal axis between opposite ends, said wall including a plurality of yarns braided with one another, said plurality of yarns including a plurality of activatable yarns and a plurality of non-activatable yarns, with all non-activatable yarns being multifilament yarns, at least some of said activatable yarns, when activated, being caused to melt, solidify and lock said plurality of yarns in fixed relation with one another to inhibit the expansion of said wall, said activatable yarns being a solid, single filament yarn.

2. The protective braided sleeve of claim 1, wherein said wall includes non-activatable yarn, with said at least one activatable yarn having a lower melt temperature than said non-activatable yarn.

3. The protective braided sleeve of claim 2, wherein said at least one activatable yarn and said non-activatable yarn are provided in an equal number of ends with one another.

4. The protective braided sleeve of claim 3, wherein said activatable yarns and said non-activatable yarns are braided in a respective 1:1 braid pattern, with said activatable yarns and said non-activatable yarns alternating with one another in opposite S and Z helical directions.

5. The protective braided sleeve of claim 2, wherein said activatable yarns and said non-activatable yarns are braided in a respective 1:2 braid pattern, with said activatable yarns and said non-activatable yarns alternating with one another in opposite S and Z helical directions.

6. The protective braided sleeve of claim 2, wherein said activatable yarns and said non-activatable yarns are braided in a respective 1:3 braid pattern, with said activatable yarns and said non-activatable yarns alternating with one another in opposite S and Z helical directions.

7. The protective braided sleeve of claim 2, wherein said activatable yarns and said non-activatable yarns are braided in a respective 2:1 braid pattern, with said activatable yarns and said non-activatable yarns alternating with one another in opposite S and Z helical directions.

8. The protective braided sleeve of claim 2, wherein said activatable yarns and said non-activatable yarns are braided in a respective 3:1 braid pattern, with said activatable yarns and said non-activatable yarns alternating with one another in opposite S and Z helical directions.

9. The protective braided sleeve of claim 1, wherein at least some of said activatable yarns include heat-shrinkable yarn, said heat-shrinkable yarn being caused to shrink 10% or more of its non-activated length upon being activated.

10. A method of constructing and applying a protective braided sleeve, comprising:

braiding a plurality of activatable yarns and a plurality of non-activatable yarns with one another to form a seamless tubular wall extending lengthwise along a central longitudinal axis;

providing the plurality of activatable yarns being solid, single filaments and providing all non-activatable yarns being multifilament yarns;

disposing the seamless tubular wall about an elongate member to be protected;

axially stretching the seamless tubular wall to take on an axially elongated, radially contracted state, such that the seamless tubular is brought into a close fit relation about the elongate member; and activating the activatable yarns in an activation step to cause at least some of the activatable yarns to melt, solidify and lock the yarns of the wall relative to one another.

11. The method of claim 10, further including braiding the activatable yarns and the non-activatable yarns in an equal number of ends with one another.

12. The method of claim 11, further including braiding the activatable yarns and the non-activatable yarns in a respective 1:1 braid pattern, with the activatable yarns and the non-activatable yarns alternating with one another in opposite S and Z helical directions.

13. The method of claim 10, further including braiding the activatable yarns and the non-activatable yarns in a respective 1:2 braid pattern, with the activatable yarns and the non-activatable yarns alternating with one another in opposite S and Z helical directions.

14. The method of claim 10, further including braiding the activatable yarns and the non-activatable yarns in a respective 1:3 braid pattern, with the activatable yarns and the non-activatable yarns alternating with one another in opposite S and Z helical directions.

15. The method of claim 10, further including braiding the activatable yarns and the non-activatable yarns in a respective 2:1 braid pattern, with the activatable yarns and the non-activatable yarns alternating with one another in opposite S and Z helical directions.

16. The method of claim 10, further including braiding the activatable yarns and the non-activatable yarns in a respective 3:1 braid pattern, with the activatable yarns and the non-activatable yarns alternating with one another in opposite S and Z helical directions.

17. The method of claim 10, further including causing at least some of the activatable yarns to shrink 10% or more of its non-activated length upon being activated in the activation step.

* * * * *